US006600126B2

(12) United States Patent
Steinhoff et al.

(10) Patent No.: US 6,600,126 B2
(45) Date of Patent: Jul. 29, 2003

(54) SHELL WITH A SHELL BODY AND A PROCESS FOR THE PREPARATION OF RADIALLY PROTRUDING GUIDING MEANS ON A SHELL BODY

(75) Inventors: Kurt Steinhoff, Burglen (CH); Matthias Schupfer, Vienna (AT)

(73) Assignee: Ruag Components, Thun (CH)

( * ) Notice: Subject to any disclaimer, the term of this patent is extended or adjusted under 35 U.S.C. 154(b) by 0 days.

(21) Appl. No.: 09/809,750

(22) Filed: Mar. 15, 2001

(65) Prior Publication Data

US 2002/0002926 A1 Jan. 10, 2002

Related U.S. Application Data

(60) Provisional application No. 60/189,961, filed on Mar. 16, 2000.

(51) Int. Cl.[7] ..... B23K 9/04
(52) U.S. Cl. ..... 219/76.14; 102/526; 219/137 WM
(58) Field of Search ..... 219/76.14, 137 R, 219/137 WM, 76.1; 102/524, 526; 228/119

(56) References Cited

U.S. PATENT DOCUMENTS

| | | | | |
|---|---|---|---|---|
| 2,353,693 A | | 7/1944 | Church | |
| 2,813,190 A | | 11/1957 | Felmley, Jr. | |
| 2,841,688 A | * | 7/1958 | Andreassen et al. | 219/76.14 |
| 2,862,101 A | * | 11/1958 | Klinke | 219/137 R |
| 3,888,295 A | | 6/1975 | Schillinger | |
| 4,797,985 A | * | 1/1989 | Prochnow et al. | 102/524 |
| 5,449,874 A | * | 9/1995 | Altenau | 102/524 |

FOREIGN PATENT DOCUMENTS

| | | |
|---|---|---|
| DE | 306 405 | 2/1920 |
| DE | 3 539 310 A1 | 5/1987 |
| EP | 0 392 084 A2 | 10/1990 |
| FR | 352 481 | 3/1906 |

* cited by examiner

*Primary Examiner*—Clifford C. Shaw
(74) *Attorney, Agent, or Firm*—Schweitzer Cornman Gross & Bondell LLP

(57) ABSTRACT

Guiding means being arranged on a surface area of a shell are made of high purity nickel by build-up welding. This avoids a drag-in of copper into a gun barrel foreseen for the launch of a shell. A production of the guiding means in the build-up welding process allows a reliable fixing of the guiding means directly onto the shell body.

13 Claims, 2 Drawing Sheets

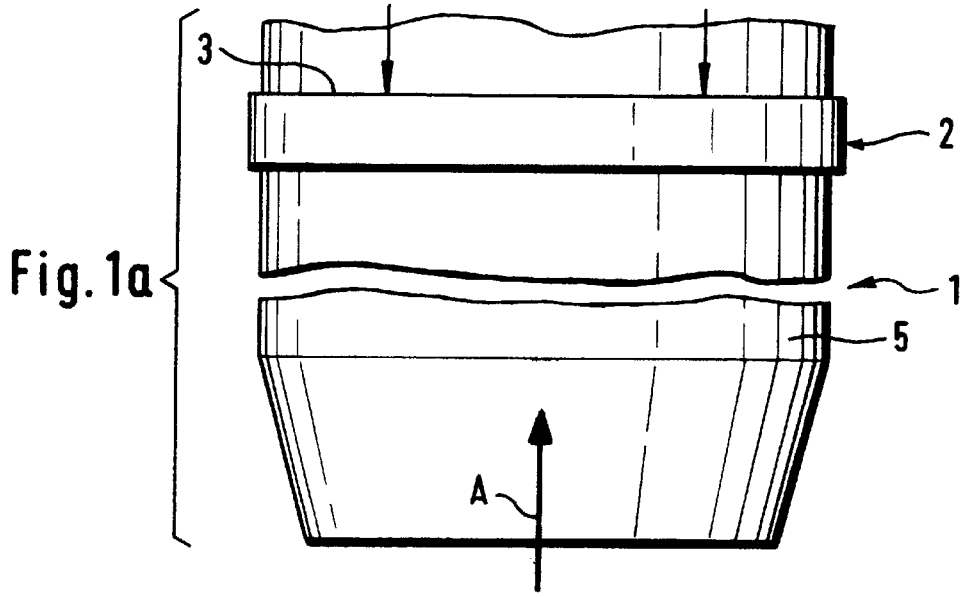
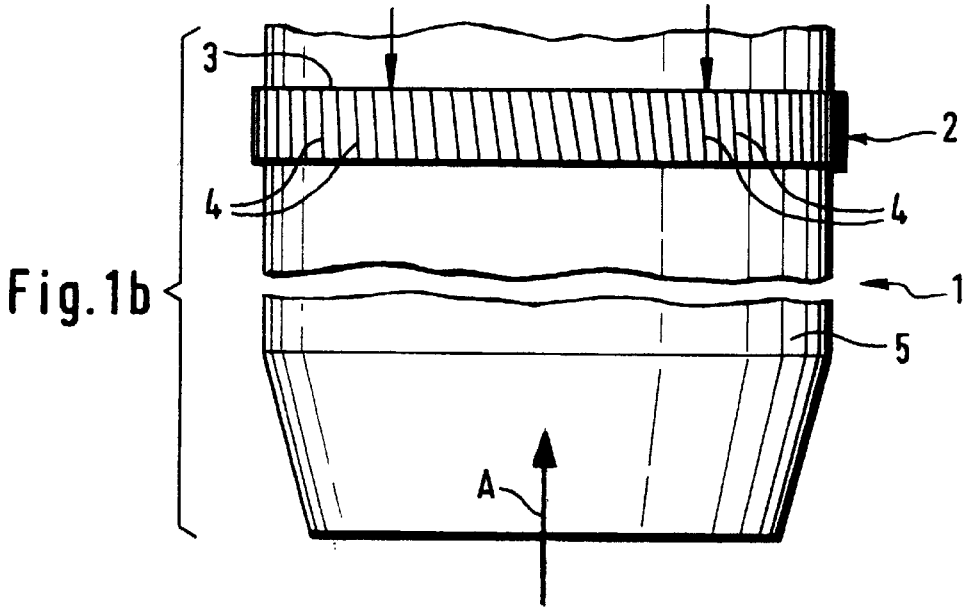
Fig. 2
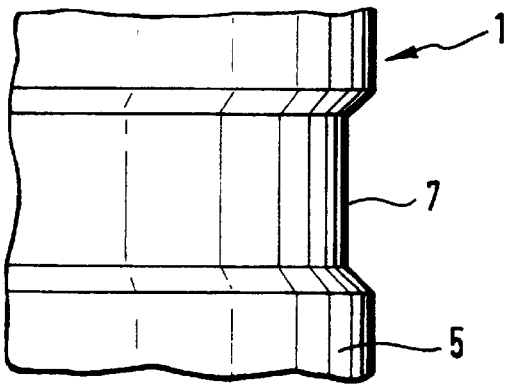
Fig. 3
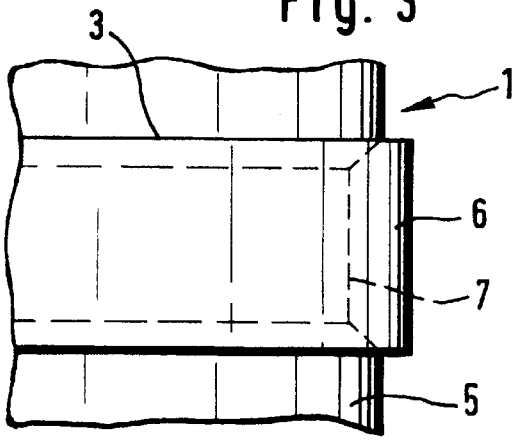

SHELL WITH A SHELL BODY AND A PROCESS FOR THE PREPARATION OF RADIALLY PROTRUDING GUIDING MEANS ON A SHELL BODY

This application claims benefit of provisional application Ser. No. 60/189,961 filed Mar. 16, 2000.

The present invention relates to a shell or missile having a shell body and guiding means being radially protrudingly arranged for guiding the shell body in a gun barrel. The invention also relates to a process for the preparation of radially protruding guiding means on a shell body of a shell to be guided in a gun barrel.

BACKGROUND 0F THE INVENTION

Known shells typically have a guiding means made of copper 15 attached to the external surface area of the shell. There are also known shells having several guiding means being arranged in a defined distance to each other in the form of ring-shaped elevations. When such a formed shell body is launched from a gun barrel whose inner surface contains several helicoidally revolving grooves, the elevations are squeezed and formed, by which the shell receives a rotation that serves to stabilize the shell on its flight path. At the same time the guiding means serve to tighten and bind the shell within the barrel against the hot powder gases impinging on the rear side of the shell and form an anti-attrition interface layer between the shell body and the gun barrel.

For the preparation of these known guiding means a circumferential groove is turned into the shell body, wherein a ring is shrinked, pressed and/or anchored by welding.

A disadvantage of the known shells is that they can drag-in copper into the gun barrel surface at firing. This can ultimately lead to an embrittlement of the gun barrel and results in a reduction of its mechanical stability. After a number of firings, depending on different initial conditions, the gun barrel is no longer serviceable. The drag-in of copper into the system's environment is also problematic, especially with ammunition that is intended for exercise purpose use.

Moreover, the high gas pressures of modem weapon systems lead to dynamic loads which such copper rings often cannot successfully resist.

BRIEF DESCRIPTION OF THE INVENTION

The present invention is therefore directed to a new and improved shell of the general type set forth, which avoids to a large extent a drag-in of copper into the gun barrel and its surroundings at firing. Moreover, the invention provides a process for the production of radially protruding guiding means in such a way that an optimal bonding of the guiding means to the shell body is achieved, whereby the transition zone between both parts can be optimizable or minimizable as appropriate. The invention also allows extremely high temperatures and gas pressure loads to arise on the guiding means without causing them to fail.

In accordance with the foregoing purposes and to solve deficiencies in the prior art, the present invention provides guiding means in which at least the radially outer area of the guiding means contains nickel.

By this structure it becomes possible to substantially reduce the copper content almost at least in the region of the shell body touching the gun barrel at launch. In this way a release of copper from the guiding means can be reliably avoided. A shell according to the invention thus avoids at its launch the drag-in of copper into the gun barrel and its surrounding. Contamination and/or reduction of the abrasion resistance at the inner surface of the gun barrel by reduction of its stability and by embrittlement due to metallurgic interaction is also thereby reliably avoidable.

The guiding means can be produced particularly economically according to another advantageous further development of the invention, in which the radially outer area of the guiding means is shaped as a nickel-containing layer attached to the basic body. The shell body has, in the area of the guiding means, a particularly high stability when the material of the basic body is made of tempered steel or maraging steel.

The connection between the nickel-containing layer and the basic body can be produced according to another advantageous further development of the invention particularly economically, when the guiding means are materially fitted to the basic body. For the material fitting the welding process is particularly suitable.

The nickel-containing layer may, for example, be applied on a rotating band. The rotating band may be subsequently connected to the shell body just as known in the art. Alternatively, however, a reduction of production costs of the shell according to the invention may be possible when the guiding means are arranged directly on the shell body.

Tests have shown that the guiding means have a particularly high stability when their nickel content amounts to more than 90%. Preferably, the guiding means consist of nickel of high purity having a nickel content of more than 99%.

The creation of the process for the production of radially protruding guiding means in such a way that the drag-in of copper into the gun barrel can be avoided therewith is addressed by the present invention by the application of a single layer containing nickel onto a basic body. By this method the copper content of the radially outer area of the guiding means can be limited to predetermined acceptable dimensions or can be completely avoided. Since the only radially outer area of the guiding means touches the gun barrel at shell launch, the transfer of copper from the guiding means to the gun barrel can reliably be avoided even when the shell body itself contains copper. The shell according to the invention thus avoids to a large extent at launch the drag-in of copper into the gun barrel. Embrittlement of the gun barrel is also reliably avoided. The basic body can alternatively be the shell body itself or a rotating band to be connected to the shell body.

The production of the guiding means according to the invention is particularly economical when the application of the nickel containing layer is made by a build-up welding process. Further, the guiding means can have particularly large dimensions.

Disadvantageous changes to the metallic structure or even fissures and micro hollow spaces in the connection of the nickel containing layer with the basic body, as a rule made out of a steel alloy, can be avoided to a large extent according to a further advantageous development of the invention, namely when the basic body is exposed to a protective gas atmosphere at 815 degrees C. during one to three hours following the build up welding process. By this heat treatment damage in the basic body produced by the welding can regress and the structure of the material of the basic body can be homogenized. By suppression of the fissures and the micro hollow spaces a shearing off of the guiding means at launch of the shell can reliably be avoided. Additionally, changes to the metallic structure, leading to a reduction of the mechanical resistance of the shell body under dynamic stress, can be undone. As the protective gas argon is particularly suitable.

According to a further advantageous development of the invention a contribution to the further reduction of the fissures and micro hollow spaces may be achieved when the basic body is exposed to a protective gas atmosphere during three to six hours at 480 degrees C. By this treatment the basic material undergoes a further increase in stability. This heat treatment preferably follows an intermediate cool down phase to room temperature after the first heat treatment at 815 degrees C.

Required tolerances of the guiding means can efficiently be met according to a further advantageous aspect of the invention, when the nickel-containing layer is shaped by metal-cutting to the planned dimensions after the build-up weld. This treatment by metal-cutting can be effected, for example, by a turning process.

BRIEF DESCRIPTION OF THE DRAWINGS

The invention allows numerous forms of realization. A further understanding of the invention will be achieved upon consideration of a preferred, but nonetheless illustrative embodiment described in the following description and shown in the annexed drawings, wherein:

FIG. 1*a* depicts a portion of a shell according to the invention before its launch;

FIG. 1*b* depicts the portion of FIG. 1*a* after shell launch;

FIG. 2 depicts a detail of the part of the shell shown in FIG. 1*a* prior to the fabrication of the guiding means;

FIG. 3 depicts a detail of the part of the shell shown in FIG. 1*a* after build-up welding for the fabrication of the guiding means.

DETAILED DESCRIPTION OF THE INVENTION

Figure 4:
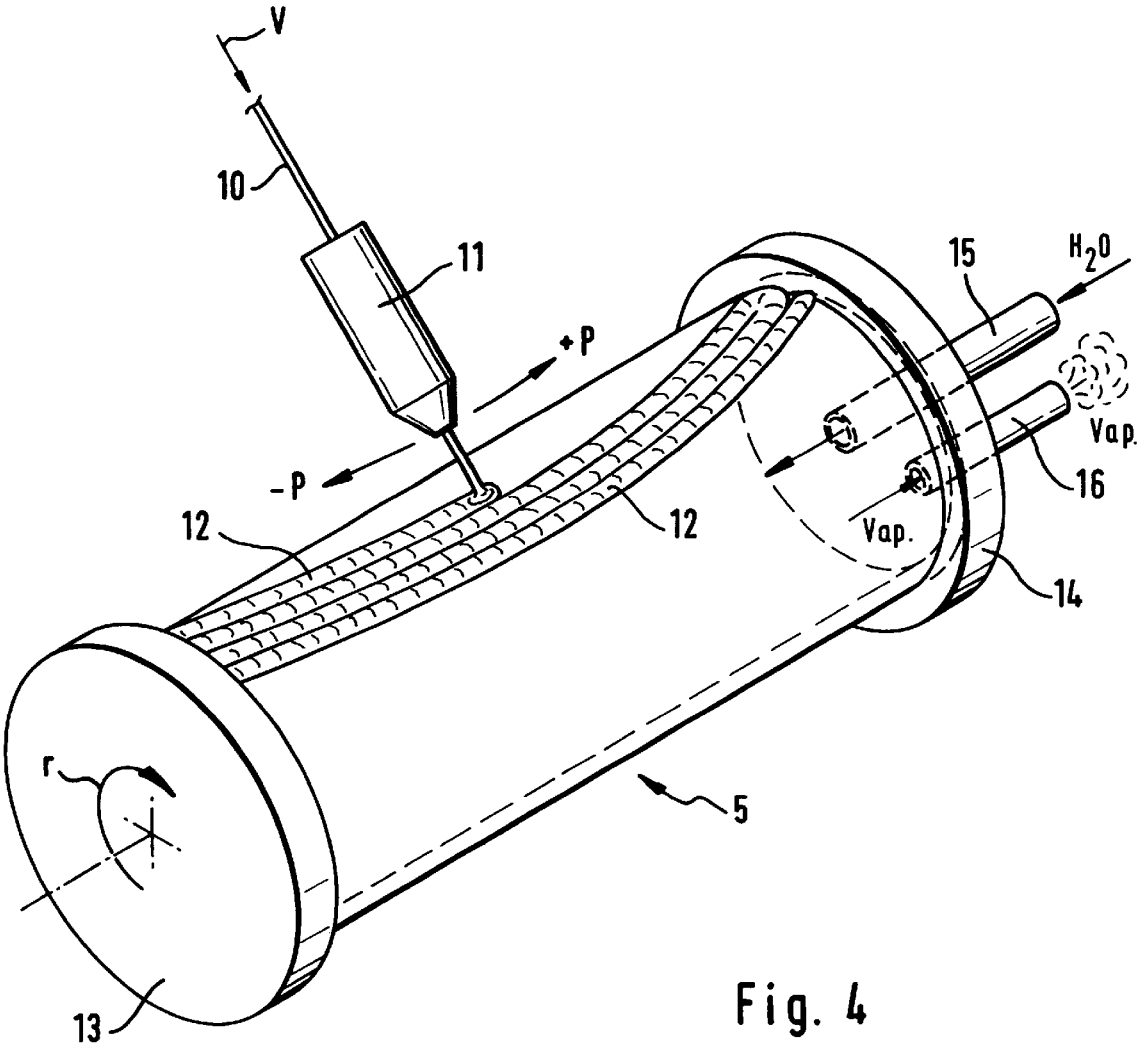
FIG. 4 depicts a simplyfied arrangement in a welding machine during the fabrication of the guiding means.

FIGS. 1*a* and 1*b* show part of a shell 1, wherein FIG. 1*a* shows the part with a guiding means 2 in its embodiment before the launch in direction. A out of a gun barrel (not shown) having a helicoidally revolving inner profile. The guiding means 2 consists of a nickel band of high purity and is fastened with anchors in a circumferential groove in the shell body 5 made of tempered steel 42CrMo4.

FIG. 1*b* shows the same part as FIG. 1*a* after launch through the gun barrel. The characteristic elevations 4 from the surface area of the shell body 1 are formed, which elevations put the shell into rotation in the gun barrel, resulting in a well-known spin stabilization of the shell on its flight-path. The rear side of the shoulder 3 of the guiding means 2 is impinged upon as depicted at 3 with powder gases during the launch and serves at the same time, as a sort of piston packing, as a highly effective sealing material, even at extremely high gas pressures.

The front part of the shell 1 is shaped in a well-known manner, the direction of launch is characterized here with an arrow and labeled "A".

Alternatively, the basic body 5 can be formed as a steel ring attached to the shell body 1.

FIGS. 2 and 3 clarify two process steps during the fabrication of the guiding means 2. First, the basic body 5 is made of a steel tube of the alloy 42CrMo4 or of maraging steel. This basic body 5, as shown in FIG. 2, has a smooth outer surface area and sloping edges towards a groove 7 formed, for example, by chamfering.

Subsequently, circular weld seams made of nickel are applied onto the basic body 5 in the groove 7, in a longitudinal direction and radially overlayed until the required thickness of a layer 6 is achieved, as shown in FIG. 3. By a gradual and symmetrical piling of sheetings for fusion welding, unfavorable effects, and especially distortion of the basic body 5, are avoided.

For the elimination of welding stress, fissures and micro hollow spaces, the basic body 5 undergoes a heat treatment after the fabrication of the circular welding layer 6. During the heat treatment the basic body 5 together with the layer 6 is first heated in an argon atmosphere to 815 degrees C. This temperature is maintained for one to three hours. After a slow cooling down to room temperature a subsequent renewed heating of the basic body 5 to 480 degrees C., takes place; this temperature is maintained for a further three to six hours. After a final cooling to room temperature the layer 6 and the basic body 5 have a homogeneous structure.

The working of the welding-layer 6 may be performed in a known manner by metal removing processing to a preset, oversized caliber.

A practical welding experiment has shown, that intensive cooling of the basic body 5 is of utmost importance. For practical reasons water cooling connected to regular water supply has been chosen and the flow of water has been regulated so that no noticable warming up of the effluent water occured. Alternatively the throughput of water has been reduced until during the welding process the cooling water completely evaporated. Applying these cooling methods even basic bodies having very thin walls suffered no distortions in their shape. Thus, the build-up welding with electric arc has been found suitable for extremely thin walled carrier projectiles for submunition. The following welding parameters proved to be workable in normal atmosphere (under workshop conditions):

EXAMPLE 1

Basic body: Ring of maraging steel 150 mm in diameter; length 120 mm; width of guiding means 52 mm.

Cooling: Water with inlet pressure of 2 bar guided over a thorn, which acts as carrier for the ring during the build-up welding with groove like flow resistancies for the reduction of the water throughput. The measured water flow rate was approximately 5 l/s.

EXAMPLE 2

Basic body: Bottom part of a projectile made of maraging steel (closed on one side) 150 mm in diameter; length 700 mm; width of guiding means 52 mm.

Cooling: Water with inlet pressure of 2 bar flowing in over a flange with an O-ring seal (upper drill-hole) and out (lower drill-hole); during the build-up welding a turbulent flow occurs in the basic body. The measured water flow rate was also approximately 5 l/s.

In both examples a welding wire 1.6 mm in diameter, from a role of wire (Baltimore Welding Division, Chesapeak Avenue, Baltimore, Ma., USA) was used. The build-up welding was carried out in a protective atmosphere (Commercial designation "Argon 45") under workshop conditions.

| | |
|---|---|
| Welding-voltage: | 28 V; direct current (MSG-Process according to DIN) |
| Welding-Current (optimized): | 230 A |
| Welding-Velocity (on rotating basic body): | 0,07 m/s |
| Pendular deflection of the weld electrode: | 26 mm |
| Pendular swing: | 0,8 s (per half wave) |

Examination of micrograps: Homogeneous Martensit structure in the effective range of the guiding means.

FIG. 4 depicts the principle of welding and cooling on a per se known welding machine (Hulftegger, Switzerland). The basic body 5 is clamped on ist front side with two flanges 13 and 14, whereby flange 13 is driven by a spindle motor (not shown) into the direction r. Flange 14 has in its center a water conduit 15, around which the flange 14 rotates. On its periphery there is inserted another tube 16, through which the evaporated water vap. may exit.

For clarity reasons, the per se known means like power lines, generator, power supply etc. are not shown in FIG. 4.

The previously described welding wire 10 is led through a guide pipe 11 which is penduling (swinging) from its center position in the directions −p and +p. The resulting welding seam 12 shown in FIG. 4 is represented in its typical pattern.

The specific parameters were:

| | |
|---|---|
| Rotation | r = 0,255 revs/min |
| The travel distance of the guide pipe 11: | −p to +p = 52 mm |
| The rate of advance of wire 10 | v = 0,066 m/s |

The described manufacturing method of the invention can be easily adapted to longer tubes and/or tubes with a larger diameter. The travel distance of the guide pipe as shown in FIG. 4 is longer than 52 mm quoted above.

Tests have shown that guiding means produced in accordance with the present invention resist significantly higher gas pressures as compared to guide rings made of copper, and by this a further significant source of danger is eliminated at the launch of the ammunition body. The service life of the gun barrels is significantly improved; likewise the radius of action of the shells can be increased, since now bigger charges with correspondingly higher gas pressures can be utilized.

We claim:

1. A process for the preparation of radially protruding guiding means on a shell body of a shell to be led in a gun barrel, comprising the steps of applying a single layer of a nickel-containing layer onto a basic body through a build-up welding process, followed by exposing the basic body to a protecting gas atmosphere at a temperature of 800 degrees C. to 850 degrees C. for one to three hours.

2. The process according claim 1 wherein the basic body is subsequently cooled to room temperature and then exposed to a protecting gas atmosphere for three to six hours at a temperature of 480 degrees C.

3. The process according to claim 1 wherein the nickel-containing layer, following the build-up welding step, is metal-cutting worked to preset dimensions.

4. The process according to claim 1 wherein the step of applying the nickel-containing layer is followed by cutting slots longitudinally in the nickel-containing layer.

5. The process according to claim 1 wherein the build-up welding process takes place in sections extending longitudinally to the shell body.

6. The process according to claim 1 wherein the build-up welding process includes the application of radially overlaid weld seams to the shell body in longitudinal directions.

7. The process according to claim 6 wherein the weld seams are applied in a longitudinally arched orientation.

8. The process according to claim 7 characterized in that the weld seams are applied by a pendulum welder.

9. The process according to claim 1 wherein the shell body is intensively cooled during the welding process.

10. The process according to claim 9 wherein the inner side of the shell body is connected to a water supply during the welding process.

11. A shell body having radially protruding guiding means formed by the process of claim 1.

12. A shell body according to claim 11, characterized in that the material of the basic body is a tempered steel 42CrMo4 or a maraging steel.

13. A shell body according to claim 11 or 12 characterized in that the guiding means contain more than 90% nickel.

* * * * *